US007686936B1

(12) United States Patent
Staerzl et al.

(10) Patent No.: US 7,686,936 B1
(45) Date of Patent: Mar. 30, 2010

(54) METHOD FOR INHIBITING FOULING OF A SUBMERGED SURFACE

(75) Inventors: Richard E. Staerzl, Fond du Lac, WI (US); Kevin R. Anderson, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 349 days.

(21) Appl. No.: 11/799,178

(22) Filed: May 1, 2007

(51) Int. Cl.
*C23F 13/04* (2006.01)

(52) U.S. Cl. ..... 205/726; 205/724; 205/725; 205/727; 205/740

(58) Field of Classification Search ..... 205/724, 205/725, 726, 727, 740
See application file for complete search history.

(56) References Cited

U.S. PATENT DOCUMENTS

| | | | | |
|---|---|---|---|---|
| 3,241,512 | A * | 3/1966 | Green | 114/222 |
| 4,345,981 | A * | 8/1982 | Bennett et al. | 205/701 |
| 5,820,737 | A * | 10/1998 | Kohn | 204/196.3 |
| 6,173,669 | B1 | 1/2001 | Staerzl | 114/222 |
| 6,197,168 | B1 * | 3/2001 | Matsunaga et al. | 204/196.01 |
| 6,209,472 | B1 | 4/2001 | Staerzl | 114/222 |
| 6,514,401 | B2 * | 2/2003 | Chyou et al. | 205/739 |
| 6,547,952 | B1 | 4/2003 | Staerzl | 205/724 |
| 6,973,890 | B1 | 12/2005 | Staerzl | 114/67 R |
| 7,025,013 | B1 | 4/2006 | Staerzl et al. | 114/222 |
| 7,131,877 | B1 | 11/2006 | Staerzl | 440/76 |
| 7,211,173 | B1 | 5/2007 | Staerzl et al. | 204/196.37 |
| 2004/0231975 | A1 * | 11/2004 | Boyd et al. | 204/196.18 |

OTHER PUBLICATIONS

U.S. Appl. No. 10/794,166, filed Mar. 2004.

* cited by examiner

*Primary Examiner*—Bruce F Bell
(74) *Attorney, Agent, or Firm*—William D. Lanyi

(57) ABSTRACT

A method for operating a system which inhibits the growth of marine organisms on a submerged surface causes a current to flow to one of two submerged surfaces over a time period that is selected as a function of the magnitude of the current and the area of the surface. In other words, the time period is determined as a function of the current density applied to the surface. In a particularly preferred embodiment the current density is maintained at approximately 35 milliamps per square foot and the time period is approximately four minutes. At the end of the time period, the current is reversed and a second submerged surface is polarized in a similar manner.

23 Claims, 3 Drawing Sheets

METHOD FOR INHIBITING FOULING OF A SUBMERGED SURFACE

BACKGROUND OF THE INVENTION

1. Field of the Invention

The present invention is generally related to a method for preventing fouling of a submerged surface and, more particularly, to a method for improving the effectiveness of a fouling prevention system while also avoiding the destruction of conductive materials used in conjunction with those submerged surfaces.

2. Description of the Related Art

Biofouling of submerged surfaces is a serious problem, particularly with regard to the hulls of boats used in saltwater environments. Those skilled in the art of marine vessels and propulsion systems have been addressing this problem for over 100 years. Some of the patents cited by the patents described immediately below were granted prior to 1914. Those patents and many more are described in the patents cited immediately below and are generally familiar to those skilled in the art. Prior attempts to prevent or discourage biofouling of submerged surfaces have used chemical treatments on those surfaces, various gases bubbled below and onto those surfaces, and various electrical schemes to generate noxious gases which inhibit or discourage the growth of marine organisms on submerged surfaces.

U.S. Pat. No. 6,173,669, which issued to Staerzl on Jan. 16, 2001, disposes an apparatus and method for inhibiting fouling of an underwater surface. The system comprises two conductive surfaces and a device that alternates the direction of electric current between the two surfaces. The current is caused to flow through sea water in which the two surfaces are submerged or partially submerged. A monitor measures the current flowing from one of the two conductive surfaces and compares it to the current flowing into the other conductive surface to assure that no leakage of current of substantial quantity exists.

U.S. Pat. No. 6,209,472, which issued to Staerzl on Apr. 3, 2001, discloses an apparatus and method for inhibiting fouling of an underwater surface. The system provides an electric current generator which causes an electric current to flow proximate the underwater surface. A source of power, such as a battery, provides electrical power to the electric current generator. The flow of current passes from the underwater surface to water surrounding the surface or in contact with the surface, and a point of ground potential. The point of ground potential can be a marine propulsion system attached to a boat on which the underwater surface is contained.

U.S. Pat. No. 6,547,952, which issued to Staerzl on Apr. 15, 2003, discloses a system for inhibiting fouling of an underwater surface. An electrically conductive surface is combined with a protective surface of glass in order to provide an anode from which electrons can be transferred to seawater for the purpose of generating gaseous chlorine on the surface to be protected. Ambient temperature cure glass (ATC glass) provides a covalent bond on an electrically conductive surface, such as nickel-bearing paint.

U.S. Pat. No. 6,973,890, which issued to Staerzl on Dec. 13, 2005, discloses a self-adaptive system for an apparatus which inhibits fouling of an underwater surface. The system automatically calibrates a marine fouling prevention system. It responds to movements between fresh and saltwater bodies of water, detects damage to the hull or other submerged surface, and responds to the use of the fouling prevention system with different sizes of marine vessels.

U.S. Pat. No. 7,025,013, which issued to Staerzl et al. on Apr. 11, 2006, discloses a multilayered submersible structure with fouling inhibiting characteristics. The structure has an outer coating that is disposed in contact with water in which the structure is submerged, a current distribution layer or charge distribution layer, an electrical conductor connectable in electrical communication to a source of electrical power, and a support structure.

U.S. Pat. No. 7,131,877, which issued to Staerzl on Nov. 7, 2006, discloses a method for protecting a marine propulsion system. An electrical conductive coating is provided on a housing structure of a marine propulsion system. By impressing a current on the electrically conductive coating, which can be a polymer material, the housing structure is used as an anode in a cathodic protection system. In addition, the use of the electrically conductive coating on the housing structure of an anode inhibits the growth of marine fouling on the outer surface of the housing structure by forming chlorine gas in a saltwater environment and by forming an acidic water layer near the surface in a non-saltwater environment.

U.S. Pat. No. 7,211,173, which issued to Staerzl et al. on May 1, 2007, discloses an improved system for inhibiting fouling of an underwater surface. The system comprises first and second conductors which are made of a polymer matrix, such as vinyl ester, and a suspended conductor, such as graphite powder or particles.

U.S. patent application Ser. No. 10/794,166 (M09775), which was filed by Staerzl on Mar. 5, 2004, discloses a method for discouraging growth of organisms in a non-saltwater environment. The method changes the chemical characteristics, ionic species, or the pH of a liquid immediately proximate a first surface. This creates an environment in that specific region which is anathema to marine organisms such as algae. It discourages the growth of marine organisms by changing the characteristic, such as the pH, of the non-saltwater liquid, to make it more acidic and less habitable to the marine organisms.

The patents described above are hereby expressly incorporated by reference in the description of the present invention.

It has been discovered that certain conductive materials are subject to destructive results when electric current is passed through the conductive surfaces while they are submerged. Although chlorine gases are produced at these conductive surfaces as a result of the current flowing through them, the conductive material can be oxidized as a result. For example, if carbon particles are used to provide the conductive surface, the carbon can be oxidized to carbon monoxide or carbon dioxide gas. As this occurs, the carbon is eventually dissipated and the effectiveness of the conductive surface is deleteriously affected. Eventually, the conductive surface becomes completely ineffective and must be repaired or replaced. It would therefore be significantly beneficial if a method could be provided which allowed for a proficient production of chlorine gas at the conductive surface in salt water and a pH change in fresh water, but avoided the destruction of the conductive material by an oxidation process.

SUMMARY OF THE INVENTION

The method for inhibiting fouling of a submerged object, in accordance with a particularly preferred embodiment of the present invention, comprises the steps of providing a source of electric power, providing a first surface which contains a first conductive material and which is disposable in a body of water, providing a second surface which contains a second conductive material and which is disposable in the body of water, wherein the second surface is electrically insulated from the first surface, and causing a first current to flow from the source of electric power to the first surface for a first time period, wherein the first time period is determined as a function of the magnitude of the first current and the area of the first surface.

In a preferred embodiment of the present invention, the first time period and the first current are selected to cause the production of chlorine or pH change on the first surface and to avoid, or minimize, the oxidation of the first conductive materials. The first current is selected, as a function of the area of the first surface, to result in a current density at the first surface which, when maintained for the first time period, is generally equivalent to a current density of 35 milliamps per square foot being maintained for approximately four minutes.

In a preferred embodiment of the present invention, it further comprises the step of causing a second current to flow from the source of electric power to the second surface for a second time period. The second time period is determined as a function of the magnitude of the second time and the area of the second surface. The second time period and the second current are selected to cause the production of chlorine on the second surface and to avoid, or minimize, the oxidation of the second conductive material.

In preferred embodiment of the present invention, the first and second currents are applied sequentially and alternately. The first and second surfaces are disposed in electrical communication with each other, through the body of water, when the first and second surfaces are both disposed in the body of water. Typically, the body of water is comprised of salt water, but this is not necessary in all applications of the present invention. The first and second surfaces can be port and starboard portions of a boat hull. The first and second conductive materials can comprise carbon particles or other forms of carbon. These carbon particles, or other forms of carbon, can be suspended in a polymer matrix.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1:
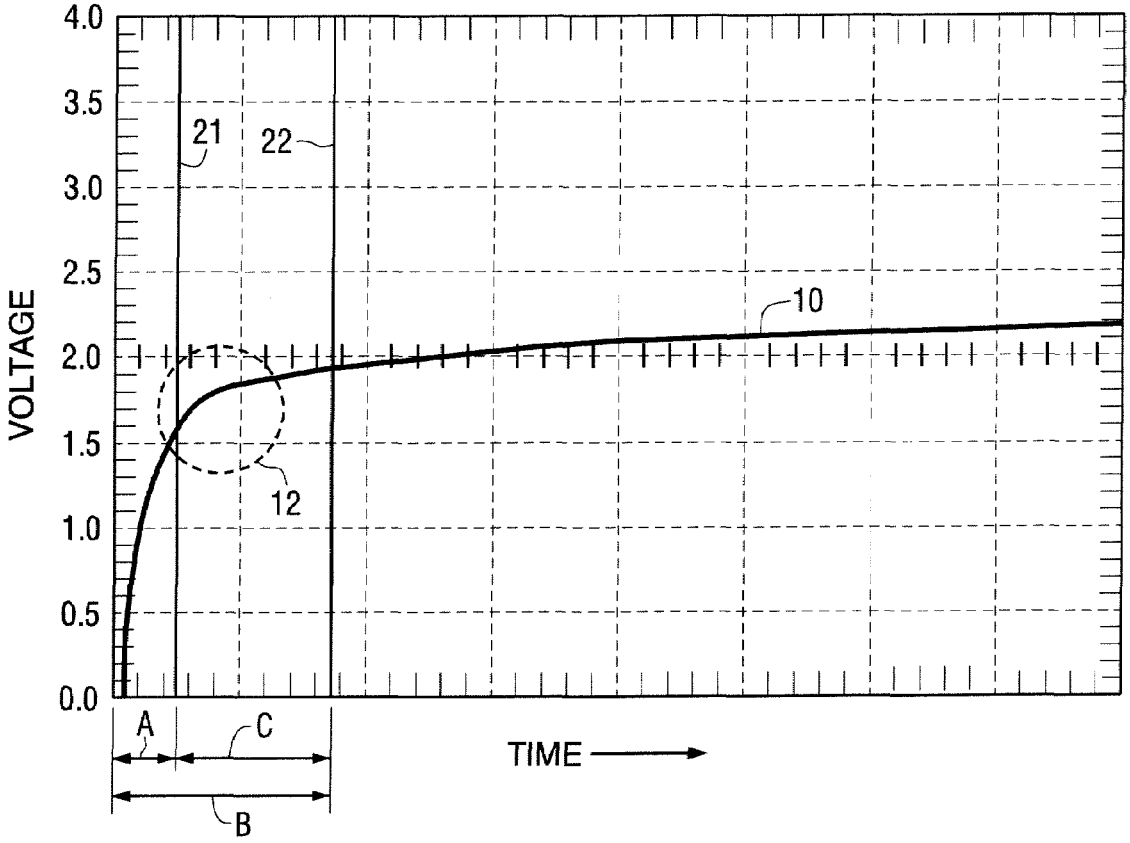
FIG. 1 illustrates a polarization curve resulting from the application of 35 milliamps per square foot to a submerged surface.

Throughout the description of the preferred embodiment of the present invention, like components will be identified by like reference numerals.

Throughout the description of the preferred embodiment of the present invention, it should be understood that it is applicable in both salt water and fresh water. In salt water, it provided an efficient and effective way to produce chlorine on the surface of a protected object. In fresh water, it efficiently and effectively causes a change in the character of the water near the surface of the protected object. This change relates to the alteration of the effective pH near that surface. The patents described above describe these effects. U.S. Pat. No. 7,131,877 describes the acidity changes resulting in fresh water.

When an electric current is provided to a submerged conductive surface, an initial flow of current polarizes the water immediately proximate the surface. During this polarization process, the voltage potential between the submerged surface and another submerged conductor rises at a first rate of increase. When the water is polarized, the increase in voltage potential slows. Subsequent to the polarization process, gaseous chlorine or a pH change is produced on the submerged conductive surface. Eventually, the rate of increase in voltage potential, between the submerged surface and another conductor, slows even more and the conductive material of the surface can begin to oxidize. This oxidation can destroy the conductive material if allowed to continue. The appropriate time, during which the current is allowed to flow to the submerged surface, to provide an adequate quantity of gaseous chlorine, or pH change, while avoiding the harmful oxidation of the conductive material, can be determined as a function of a current density provided to the submerged surface.

It has been discovered that a relatively straightforward calibration procedure can be implemented to determine the proper time period during which a preselected current density can be applied to advantageously produce gaseous chlorine, or pH change, while avoiding the harmful oxidation of the conductive material of the submerged surface.

Figure 2:
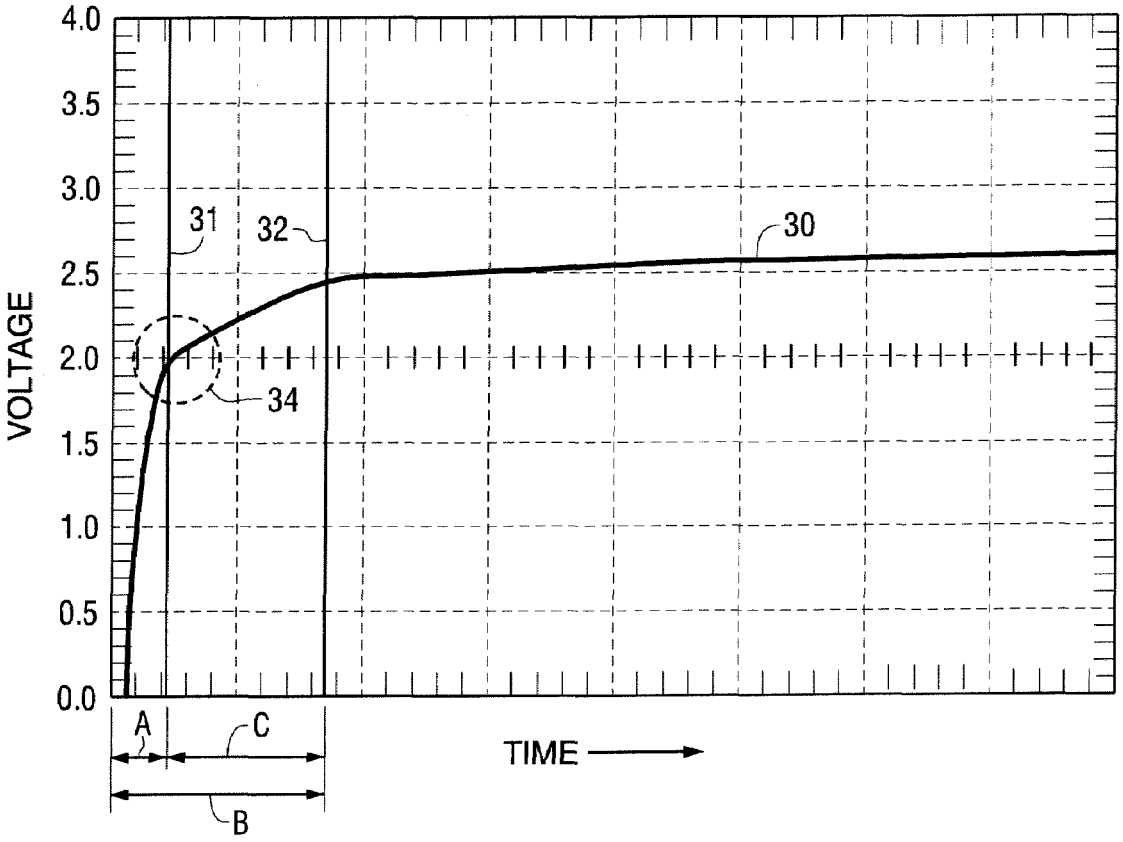
FIG. 2 illustrates the application of a current density of 175 milliamps per square foot to a submerged surface.

FIGS. 1 and 2 illustrate two examples which show two different embodiments of the present invention. The embodiment which will be described in conjunction with FIG. 1 applies a preselected current density to a submerged surface for a calculated time period. The embodiment of the present invention described below in conjunction with FIG. 2 applies a significantly higher current density for a much shorter time period to achieve similar results.

With reference to FIG. 1, line 10 illustrates the relationship between the voltage potential between a submerged surface and a reference electrode plotted as a function of time. Line 10 results from the application of a current to a submerged surface and represents the voltage differential between the submerged surface and an electrical conductor which is also submerged in the same water as the surface. It can be seen that the voltage rises at a relatively significant rate during the initial flow of current to the surface and then this rate of increase in voltage potential decreases significantly. Dashed circle 12 identifies the region where this change occurs. The "knee" of line 10 occurs at approximately the time when the polarization at the submerged surface is completed. During this initial period of time when polarization is occurring, which is identified as A in FIG. 1, results in very little production of gaseous chlorine, or pH change, at the submerged surface when the surface is submerged in salt water. However, during the period identified as C in FIG. 1, gaseous chlorine, or pH change, is produced on the submerged surface in sufficient quantity to inhibit the growth of marine organisms. As the voltage differential represented by line 10 approaches approximately 1.9 volts, the production of oxygen at the submerged surface begins. As a result, if the current continues beyond the time period identified as B in FIG. 1, some of the conductive material of the submerged surface will begin to be oxidized. This can result in the eventual destruction of the material and can cause it to be ineffective for future chlorine production, or pH change.

With continued reference to FIG. 1, the current density flowing to the submerged surface, which resulted in line 10, was 35 milliamps per square foot.

Chlorine production began at approximately 1.3 volts. The process began to produce oxygen on the submerged surface when line 10 reached approximately 1.7 volts and carbon dioxide was produced at the surface at approximately 1.9 volts and above. Since the conductive material used in the submerged surface comprised carbon particles, the production of carbon monoxide or carbon dioxide indicates that some of the carbon was oxidized. This oxidation of the conductive material of the submerged surface will eventually result in the ineffectiveness of the chlorine production, or pH change, system. In FIG. 1, the period of time identified as A is approximately 60 seconds and it coincides with a voltage differential of approximately 1.5 volts between the submerged surface and an electrical conductor disposed in the same water. The time period identified as B in FIG. 1 is approximately four minutes (240 seconds) and coincides with the voltage differential of approximately 1.9 volts.

The implications of FIG. 1 indicate that the direction of current flow, between two submerged surfaces in a body of water, should be switched after a time period of between 60 seconds and 240 seconds. Naturally, switching at 60 seconds would not benefit from a significant production of chlorine gas since that time period represents the beginning of chlorine production following the polarization process described above. Similarly, extending the time period to the maximum value of 240 seconds could possibly risk some slight degradation of the surface because of oxidation of the conductive material. Although this degradation would be slight, it should be understood that the time period used to apply the current to the submerged surface should be between the two lines, 21 and 22, in FIG. 1 and preferably slightly less than the 240 seconds represented by line 22. This would allow the conductive material to last a very long time with little or no degradation. It should be understood that, during period A, polarization occurs and, at the "knee" of the curve (proximate dashed circle 12), the beneficial production of chlorine begins. This chlorine production continues during period C.

FIG. 2 is generally similar to the graphical representation in FIG. 1, but represents a relationship between the differential voltage when a much higher current density is applied. FIG. 2 shows the empirical results when a current density of 175 milliamps per square foot is applied to the surface. The achievement of the "knee" in dashed box 34 occurs much more quickly. Time period A in FIG. 2 is approximately 10 to 12 seconds. Similarly, the beginning of oxygen production occurs at approximately 2.2 volts, with the production of carbon monoxide or carbon dioxide beginning at approximately 2.4 volts. Production of chlorine begins at approximately 1.8 volts which is represented by line 31 in FIG. 2. Time period B in FIG. 2 is approximately 48 seconds.

With continued reference to FIG. 2, it can be seen that line 30 exhibits two changes in the rate of rise of the voltage. The first is at the "knee" in dashed circle 34 and the second is at the point where line 30 crosses line 32. During the time period identified as C in FIG. 2, chlorine gas, or pH change, is produced with little or no production of carbon monoxide or carbon dioxide gas which would indicate little or no oxidation of some of the conductive carbon of the submerged surface. FIG. 2 shows that if a current density of 1.75 milliamps per square foot is used, the current flow should be limited to a time period between 10 seconds, at line 31, and 48 seconds, at line 32. These times for lines 31 and 32 are each approximately one fifth of the times represented by lines 21 and 22 in FIG. 1, respectively. This conforms with the fact that the current density of 175 milliamps per square foot represented in FIG. 2 is five times the current density of 35 milliamps per square foot represented in FIG. 1.

As described above, one particular application of the present invention causes 35 milliamps per square foot to flow for approximately four minutes before reversing the direction of current flow between the first and second surfaces. Alternatively, the other embodiment described above causes 175 milliamps per square foot to flow for approximately 48 seconds. The time period during which the current is caused to flow varies inversely with the current density applied. As a result, many different magnitudes of currents can be used, according to the present invention, with various different time periods that are determined accordingly. In addition, it should be understood that the size of the boat hull will naturally affect the current requirement in order to maintain a preselected current density. It is therefore helpful if a calibration procedure is used to determine the various parameters that should be used during the operation of the present invention. One suitable calibration procedure begins with an application of an electric current of 200 milliamps between the port and starboard surfaces of the marine vessel. This current is sufficiently low to result in an IR voltage drop through the water of less than 0.1 volts for a boat that is 20 feet in length or longer. A 20 foot boat has a wetted surface that is approximately equal to 60 square feet. This will result in a current density of approximately three milliamps per square foot. The voltage drop through the sea water would be approximately 0.01 volts which is determined by multiplying three milliamps by 3.6 ohms. The second step of the calibration procedure comprises the measurement of time that it takes for the voltage between the portions of the hull to reach 1.9 volts. For a boat that is approximately 20 feet long, this time will be approximately 40 minutes. The third step of the procedure is to divide the measured time (e.g. 40 minutes) by a desired time of four minutes and then multiply the results by 200 milliamps. This results in the current that should be applied to the hull surface in order to yield a current density of 35 milliamps per square foot. It has been determined that the time required to reach 1.9 volts is approximately four minutes with a current density of 35 milliamps per square foot.

Figure 3:
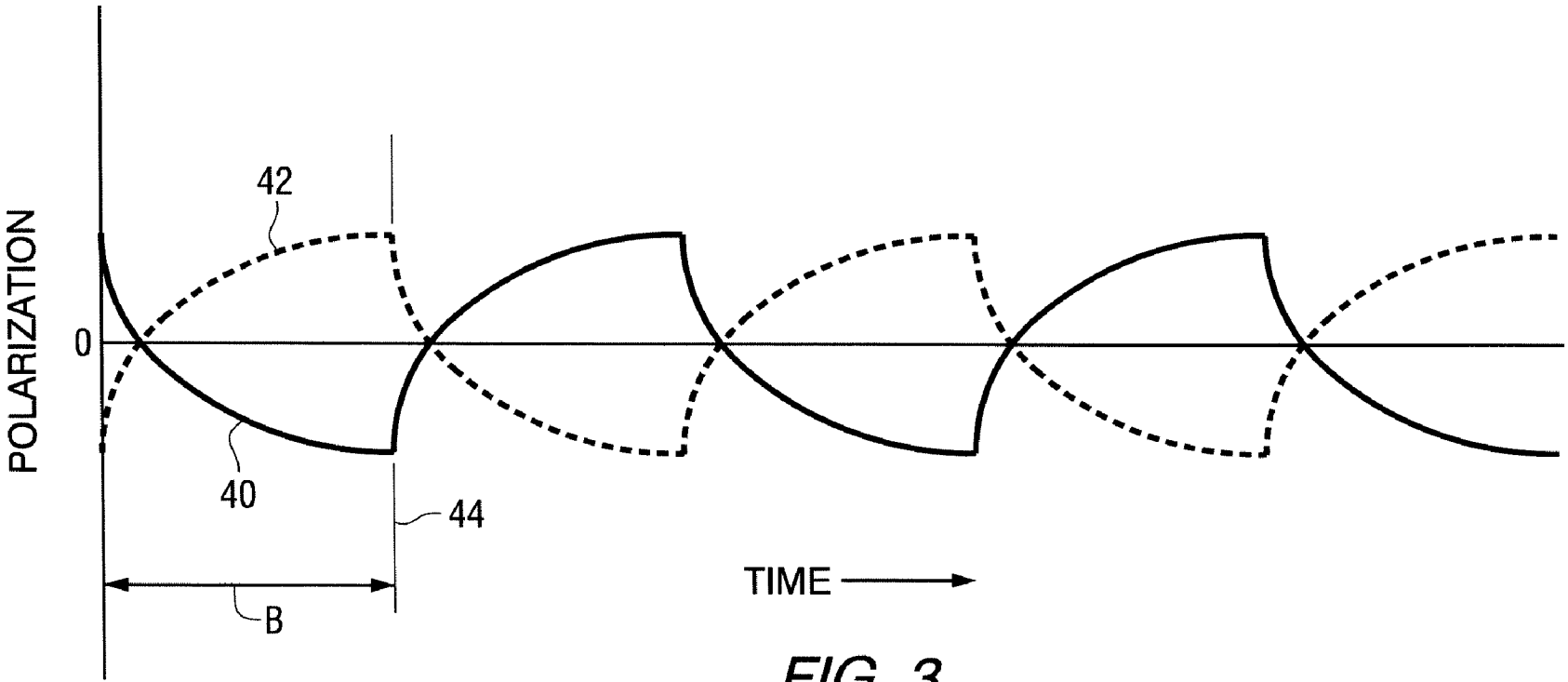
FIG. 3 shows the polarization curve of port and starboard hulls of a marine vessel.

FIG. 3 represents the polarization condition of the port and starboard hull portions for a marine vessel using a preferred embodiment of the method of the present invention. The solid line 40 represents the polarization characteristic of the port side of a marine vessel and the dashed line 42 represents the polarization characteristic of the starboard side of the marine vessel. As described in the patents cited above, it is known that periodic switching of the direction of current flow between first and second surfaces is beneficial in at least two ways. First, it allows both of the first and second surfaces to act as an anode and produce gaseous chlorine, or pH change, on a surface. In addition, by reversing the polarity and causing each of the surfaces to periodically act as a cathode, damage to the conductive materials used in the first and second surfaces is avoided. FIG. 3 shows the polarization characteristics of the port and starboard hulls, 40 and 42. As the starboard hull 42 is polarized as described above in conjunction with FIGS. 1 and 2, the polarization of the port hull 40 is reversed as a result of the ionic transfer provided by the sea water in which both hulls are submerged. Time period B represents the time, such as four minutes, during which current is provided to the starboard hull 42. Simultaneously, the polarization of the port hull 44 is reversed. During the time period identified as B in FIG. 3, chlorine, or pH change, is created on the starboard surface 42. The direction of current flow is reversed at the time represented by line 44 as the port hull begins its polarization process while the starboard hull 42 experiences a reversal of polarization. As this procedure continues, chlorine gas, or pH change, is produced on the hull portion that is connected as an anode and to which electric, current is provided by the power source. By limiting the time period B to a length which does not allow sufficient time for oxidation of the conductive material to occur, such as the oxidation of carbon to produce carbon dioxide, the life of the conductive material and the effectiveness of the first and second surfaces in inhibiting biofouling are extended significantly. It has been determined that oxidation of carbon particles in the first and second surfaces is the primary reason for reduced effectiveness and shortened life of the biofouling inhibiting system.

Although the present invention has been described in considerable detail and illustrated to show several preferred embodiments, it should be understood that alternative embodiments are also within its scope.

We claim:

1. A method for inhibiting fouling on a submerged object, comprising the steps of:

providing a source of electric power;

providing a first surface which contains a first conductive material and which is disposable in a body of water;

providing a second surface which contains a second conductive material and which is disposable in said body of water, said second surface being electrically insulated from said first surface; and causing a first current to flow from said source of electric power to said first surface for a first time period, said first time period being determined as a function of the magnitude of said first current and the area of said first surface, said first time period and said first current being selected to avoid the oxidation of said first conductive material.

2. The method of claim 1, wherein:

said first time period and said first current are selected to cause the production of chlorine on said first surface.

3. The method of claim 1, wherein:

said first time period and said first current are selected to cause a pH change on said first surface.

4. The method of claim 1, wherein:

said first current is selected, as a function of the area of said first surface, to result in a current density at said first surface which, when maintained for said first time period, is generally equivalent to a current density of 35 milliamps per square foot being maintained for approximately four minutes.

5. The method of claim 1, further comprising:

causing a second current to flow from said source of electric power to said second surface for a second time period, said second time period being determined as a function of the magnitude of said second current and the area of said second surface.

6. The method of claim 5, wherein:

said second time period and said second current are selected to cause the production of chlorine on said second surface and to avoid the oxidation of said second conductive material.

7. The method of claim 5, wherein:

said second current is selected, as a function of the area of said second surface, to result in a current density at said second surface which, when maintained for said second time period, is generally equivalent to a current density of 35 milliamps per square foot being maintained for approximately four minutes.

8. The method of claim 5, wherein:

said first and second currents are applied sequentially and alternately.

9. The method of claim 1, wherein:

said first and second surfaces are disposed in electrical communication with each other, through said body of water, when said first and second surfaces are both disposed in said body of water.

10. The method of claim 1, wherein:

said body of water comprises salt water.

11. The method of claim 1, wherein:

said body of water comprises fresh water.

12. A method for inhibiting fouling on a submerged object, comprising the steps of:

providing a source of electric power;

providing a first surface which contains a first conductive material and which is disposable in a body of water;

providing a second surface which contains a second conductive material and which is disposable in said body of water, said second surface being electrically insulated from said first surface;

causing a first current to flow from said source of electric power to said first surface for a first time period, said first time period being determined as a function of the magnitude of said first current and the area of said first surface; and causing a second current to flow from said source of electric power to said second surface for a second time period, said second time period being determined as a function of the magnitude of said second current and the area of said second surface, said first and second currents being applied sequentially and alternately.

13. The method of claim 12, wherein:

said first time period and said first current are selected to cause the production of chlorine on said first surface and to avoid the oxidation of said first conductive material; and said second time period and said second current are selected to cause the production of chlorine on said second surface and to avoid the oxidation of said second conductive material.

14. The method of claim 12, wherein:

said first time period and said first current are selected to cause a pH change on said first surface and to avoid the oxidation of said first conductive material; and said second time period and said second current are selected to cause a pH change on said second surface and to avoid the oxidation of said second conductive material.

15. The method of claim 12, wherein:

said first current is selected, as a function of the area of said first surface, to result in a current density at said first surface which, when maintained for said first time period, is generally equivalent to a current density of 35 milliamps per square foot being maintained for approximately four minutes; and said second current is selected, as a function of the area of said second surface, to result in a current density at said second surface which, when maintained for said second time period, is generally equivalent to a current density of 35 milliamps per square foot being maintained for approximately four minutes.

16. The method of claim 12, wherein:

said first and second surfaces are disposed in electrical communication with each other, through said body of water, when said first and second surfaces are both disposed in said body of water.

17. The method of claim 12, wherein:

said body of water comprises salt water.

18. The method of claim 12, wherein:

said first and second surfaces are port and starboard hull surfaces, respectively, of a marine vessel.

19. The method of claim 12, wherein:

said first and second conductive materials comprise carbon particles.

20. A method for inhibiting fouling on a submerged object, comprising the steps of:

providing a source of electric power;

providing a first surface which contains a first conductive material and which is disposable in a body of water;

providing a second surface which contains a second conductive material and which is disposable in said body of water, said second surface being electrically insulated from said first surface;

causing a first current to flow from said source of electric power to said first surface for a first time period, said first time period being determined as a function of the magnitude of said first current and the area of said first surface; and causing a second current to flow from said source of electric power to said second surface for a second time period, said second time period being determined as a function of the magnitude of said second current and the area of said second surface, said first and second currents being applied sequentially and alternately, said first time period and said first current being selected to cause the production of chlorine on said first surface and to avoid the oxidation of said first conductive material, said second time period and said second current being selected to cause the production of chlorine on said second surface and to avoid the oxidation of said second conductive material, said first and second surfaces being disposed in electrical communication with each other, through said body of water, when said first and second surfaces are both disposed in said body of water, said first and second surfaces being port and starboard hull surfaces, respectively, of a marine vessel.

21. The method of claim 20, wherein:

said first current is selected, as a function of the area of said first surface, to result in a current density at said first surface which, when maintained for said first time period, is generally equivalent to a current density of 35 milliamps per square foot being maintained for approximately four minutes; and said second current is selected, as a function of the area of said second surface, to result in a current density at said second surface which, when maintained for said second time period, is generally equivalent to a current density of 35 milliamps per square foot being maintained for approximately four minutes.

22. The method of claim 21, wherein:

said body of water comprises salt water and said first and second conductive materials comprise carbon particles.

23. A method for inhibiting fouling on a submerged object, comprising the steps of:

providing a source of electric power;

providing a first surface which contains a first conductive material and which is disposable in a body of fresh water;

providing a second surface which contains a second conductive material and which is disposable in said body of fresh water, said second surface being electrically insulated from said first surface; and causing a first current to flow from said source of electric power to said first surface for a first time period, said first time period being determined as a function of the magnitude of said first current and the area of said first surface.

* * * * *